United States Patent [19]

Smugor

[11] 3,943,631

[45] Mar. 16, 1976

[54] ADAPTER FOR INDICATING ON WALL PANELS AND THE LIKE THE LOCATION OF ELECTRICAL RECEPTACLE BOXES OR THE LIKE

[76] Inventor: Carl D. Smugor, 49 Park Ave., Middleport, N.Y. 14105

[22] Filed: Mar. 29, 1974

[21] Appl. No.: 456,000

[52] U.S. Cl. ..... 33/174 G; 33/DIG. 10; 211/126

[51] Int. Cl.[2] ..... B25H 7/04; G01B 3/14

[58] Field of Search ..... 33/DIG. 10, 174 G; 211/126

[56] References Cited

UNITED STATES PATENTS

| | | | |
|---|---|---|---|
| 1,147,975 | 7/1915 | Ruff | 211/126 |
| 2,775,812 | 1/1957 | Mohr | 33/DIG. 10 |
| 2,962,281 | 11/1960 | Hodgson | 33/DIG. 10 |
| 3,745,664 | 7/1973 | Altseimer | 33/DIG. 10 |

*Primary Examiner*—Richard E. Aegerter
*Assistant Examiner*—Willis Little

[57] ABSTRACT

An adapter for attachment to electrical receptacle boxes and the like to provide an indication of the outline thereof on wall panels or boards, the adapter having a lip for removably securing a planar member thereof to the corners of a receptacle box, the planar member having a projecting beveled end which makes an impression or indentation on the wall panel or board when in contact therewith.

4 Claims, 8 Drawing Figures

ADAPTER FOR INDICATING ON WALL PANELS AND THE LIKE THE LOCATION OF ELECTRICAL RECEPTACLE OR THE LIKE BOXES

The present invention relates to the installation of walls, more particularly, wall boards and panels in rooms.

In the installation of wall boards and wood paneling the proper alignment with existing electrical receptacles and the like has been a long standing problem.

Various approaches and devices have been suggested to overcome this problem. Such approaches are typified by the following prior patents; U.S. Pat. Nos. 2,788,151; 2,830,662; and 3,260,400, which patents all relate to a specially designed receptacle which coacts with the wall board in such a manner that an indication or cut-out of the location of the receptacle is made on the wall board to assure proper alignment.

The present invention has as its objective, similar to the prior patents mentioned above, the proper alignment between the wall board and/or paneling and the electrical receptacle box or the like. However, the present invention contemplates the use of an adapter that is removable, reusable and particularly suited, unlike the prior patents, to conventional or standard receptacles. Additionally, the adapters of the present invention are inexpensive and easier to manufacture when compared to specially designed receptacles. More importantly, the adapters of the present invention will easily permit the homeowner or worker to replace existing walls or panels that, more than likely, did not contain or coact with specially designed receptacles for alignment purposes.

Basically, the present invention provides an alignment indicator that is adapted to be removably secured to electrical receptacle boxes or the like, comprising; a member having means for removable attachment to an edge of a receptacle box, the member having an end portion which projects beyond the receptacle box when attached thereto, and means on the edge of the end portion for contacting a wall panel and the like and making on the same an indication of the position of the member with respect to the receptacle.

For a fuller understanding of the present invention reference should now be had to the following detailed description of the same taken in conjunction with the accompanying drawings, wherein:

FIG. 2 is a pictorial representation of one of the adapters of FIG. 1 depicting its installation on a receptacle box and its coaction with a panel or the like;

Figure 1:
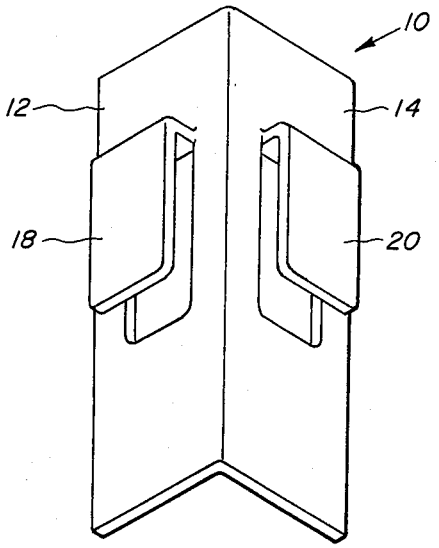
FIG. 1 is a pictorial representation of one form of adapter according to the present invention.
Figure 2:
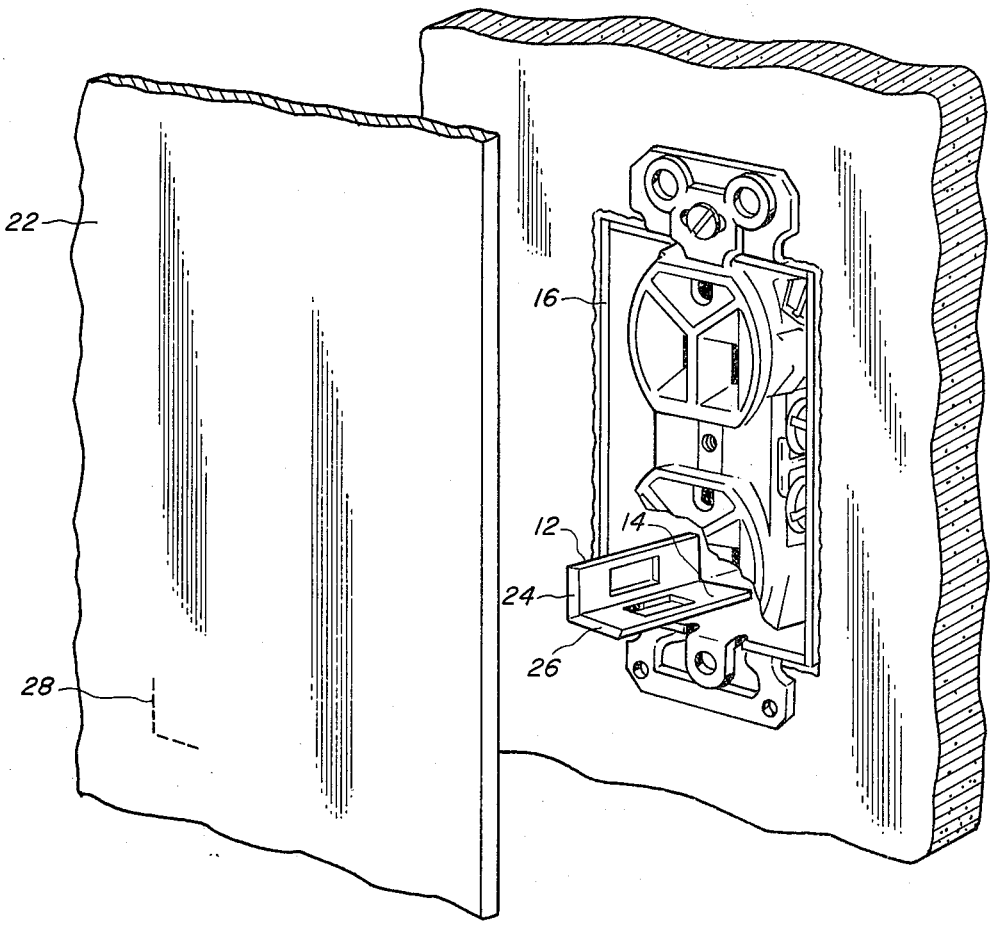

Referring now to the drawings and, more particularly, to FIGS. 1 and 2 the adapter according to the present invention is generally depicted at 10 and comprises a pair of substantially flat or planar rectangular sections 12, 14 joined together or bent to form a right angle therebetween.

Means are provided to secure the adapter 10 to the corner of a receptacle box or the like 16. Such means may conveniently take the form of a pair of pressed out tabs or lips, the main bodies 18 and 20 of which are spaced from the plane containing sections 12 and 14. The spacing is such to permit the adapter to fit each corner of a receptacle box and project therefrom as indicated in FIG. 2.

The projecting end of each section 12, 14 contains suitable means to provide an indication of the outline or corners of the receptacle box 16 on a wall panel or board when in contacting relationship therewith. Such means may, by way of illustration and not limitation, take the form of beveled edges 24, 26 which function to leave an impression 28 on the panel or board 22. With four adapters 10 in place on the four corners of the receptacle the impression formed on the panel or board will establish a satisfactory guide from which a proper opening can be cut. It is to be understood that other means instead of bevels can be utilized on the projecting edges, such as for example chalk or carbon black.

Figure 3:
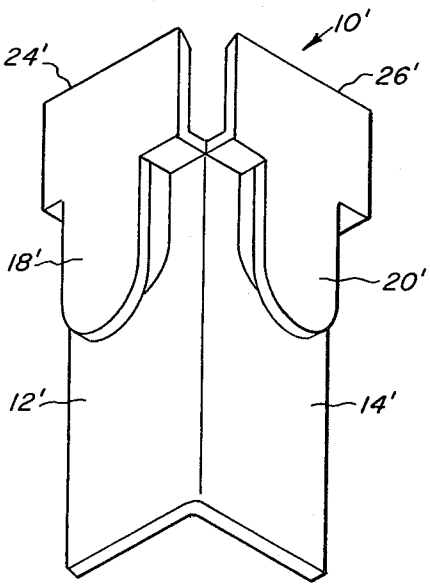
FIG. 3 is a pictorial representation of a second embodiment of the adapter according to the present invention.
Figure 4:
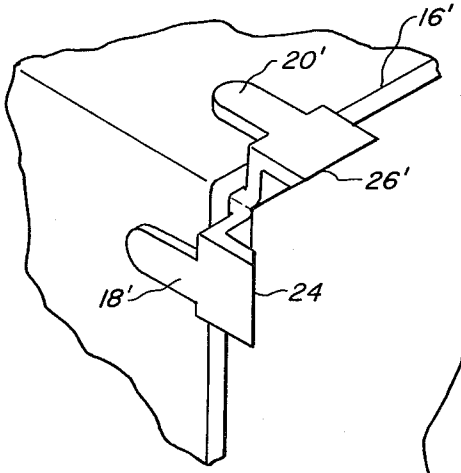
FIG. 4 is a pictorial fragmentary view of the adapter of FIG. 3 installed on a receptacle.

FIGS. 3 and 4 illustrate similar adapters and similar numerals with the addition of primes will be used to depict similar parts. The only difference between this embodiment and the FIG. 1 embodiment is that the projecting edges 24', 26' lie in the plane of the tabs 18', 20' to provide a slightly larger guide or outline on the panel or board and one that is substantially equal to the outer dimensions of the receptacle.

Figure 5:
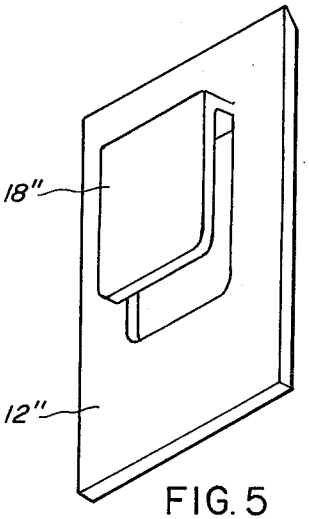
FIG. 5 is a pictorial representation of a third embodiment of the adapter according to the present invention.
Figure 7:
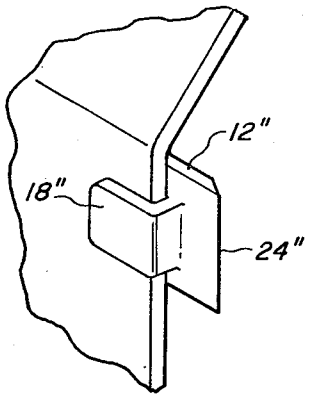
FIG. 7 is a fragmentary pictorial representation of the manner in which the adapter of FIG. 5 is attached to a receptacle box.
Figure 6:
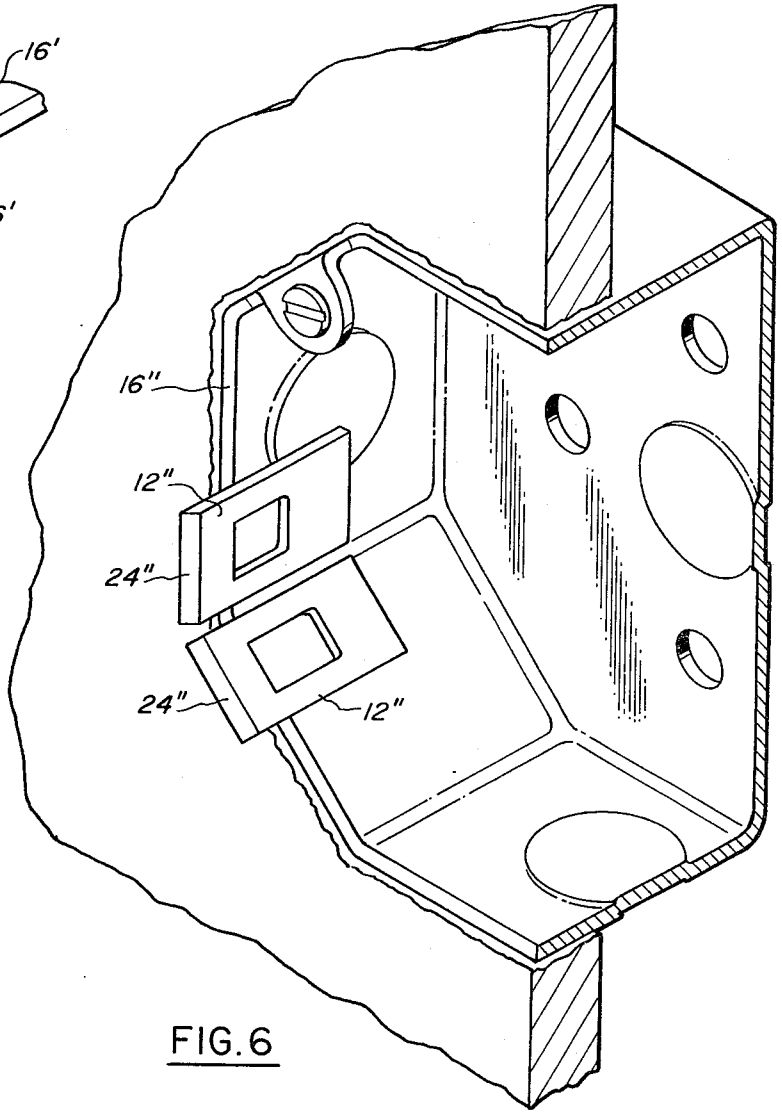
FIG. 6 is a pictorial representation of two of the adapters of FIG. 5 as installed on an irregularly shaped receptacle.

FIGS. 5, 6 and 7 represent similar adapters wherein a single section or member 12'' with a lip 18'' is utilized for irregularly shaped receptacle boxes 16'' such that a plurality of these members may be attached to the receptacle to give an indication of the outline thereof on a panel or board in contact therewith.

Figure 8:
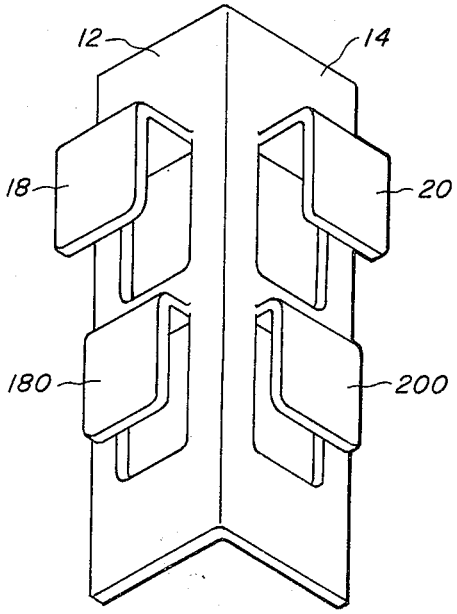
FIG. 8 is a pictorial representation of a fourth embodiment of the adapter according to the present invention.

FIG. 8 represents a modification wherein the adapter can accommodate receptacle boxes of varying thicknesses. Thus, a second set of lips or tabs 180 and 200 are provided in addition to lips 18 and 20, the spacing of which from the sections 12 and 14 is different.

Although only one adapter has been illustrated in FIG. 2 for a square or rectangular receptacle box, it is to be understood that in use four adapters would be attached at each corner thereof.

Preferred embodiments of the present invention have been disclosed and described; however, changes will occur to those skilled in the art. It is therefore intended that the present invention be limited only by the scope of the appended claims.

What is claimed is:

1. An adapter for electrical receptacle boxes or the like, comprising;

a. at least one substantially planar member, b. means attached to said member for removably securing said member on an edge of an electrical receptacle box, c. said member having an end projecting from said means and outwardly from an electrical receptacle box when secured thereto, d. means on said end for providing an indication of the location of said end with respect to an electrical receptacle box when secured thereto, and e. said means attached to said member comprises two lips the main portions of which are parallel to and spaced different distances from said member.

2. The adapter according to claim 1, further comprising;

f. an additional member identical to said planar member attached perpendicularly thereto.

3. The adapter according to claim 2, wherein said means on said end comprises a beveled edge.

4. The adapter according to claim 1 wherein said end is substantially in the plane of said planar member.

* * * * *